US005727751A

United States Patent [19]

Liu

[11] Patent Number: 5,727,751

[45] Date of Patent: Mar. 17, 1998

[54] CENTRAL ROTATING SHAFT OF A RACK FOR TISSUE SCROLL

[76] Inventor: Jackie Liu, P.O. Box 87-432, Taipei, Taiwan

[21] Appl. No.: 853,531

[22] Filed: May 9, 1997

[51] Int. Cl.[6] ..... B65M 16/06

[52] U.S. Cl. ..... 242/599.1

[58] Field of Search ..... 242/598, 598.3, 242/599.1

[56] References Cited

U.S. PATENT DOCUMENTS

| | | | |
|---|---|---|---|
| 4,212,434 | 7/1980 | Walker | 242/599.1 |
| 4,447,015 | 5/1984 | Peterson | 242/599.1 |
| 4,759,510 | 7/1988 | Singer | 242/599.1 |
| 5,374,008 | 12/1994 | Halvorson et al. | 242/599.1 |
| 5,467,935 | 11/1995 | Moody | 242/599.1 |

FOREIGN PATENT DOCUMENTS

| | | |
|---|---|---|
| 149070 | 1/1991 | Taiwan . |
| 174192 | 12/1991 | Taiwan . |
| 298807 | 2/1997 | Taiwan . |

*Primary Examiner*—John P. Darling

*Attorney, Agent, or Firm*—Clifford W. Browning; Woodard, Emhardt, Naughton, Moriarty & McNett

[57] ABSTRACT

In the central rotating shaft of a rack for a tissue scroll an inner sleeve passes through a cover ring, and a spring is placed at an opening end of the inner sleeve; then the opening end of the inner sleeve and the spring are received in an opening end of a outer sleeve, and finally, the cover ring is engaged with the opening end of the outer sleeve such that the inner sleeve can be retractable between the outer sleeve and the cover ring by the force of the spring.

5 Claims, 4 Drawing Sheets

CENTRAL ROTATING SHAFT OF A RACK FOR TISSUE SCROLL

BACKGROUND OF THE INVENTION

1. Field of the invention

The present invention relates to a rack for tissue scroll, and in particular, to a central rotating shaft of a rack for tissue scroll having a built-in spring.

2. Description of the prior art

Tissue scroll has been used for a long tome, and racks for tissue scroll also have various structures. In general, there are three types of racks for tissue scroll as follows:

type I: rack without a central rotating shaft, such as Taiwan Utility Model Publication No. 298807 "Improved structure of a rack for tissue paper";

type II: rack with a central rotating shaft (or the like) but without a spring (or the like), such as Taiwan Utility Model Publication No. 174192 "Support for tissue scroll"; and type III: rack with a central rotating shaft (or the like) and with a spring (or the like), such as Taiwan Utility Model Publication No. 149070 "Improved structure of a central fixing rod for tissue scroll".

The racks for tissue scroll of type I and type II are designed for improving the rack of type III, and the primary objects of said type I and type II are to avoid the using of a spring (or the like) in order to simplify the structure. However, when in use and particularly when replacing the old tissue scroll with a new tissue scroll, it is difficult for users to use such racks for tissue scroll.

The central rotating shaft of the rack of type III, when in use and particularly when replacing the old tissue scroll with a new tissue scroll, is very convenient, but it is difficult to appropriately mount and fix the spring (or the like). Further, there are also some problems which are not easy to be solved: i.e., how to overcome the inconvenience of manufacturing and assembling, for example, the spring being not easy to be fixed, how to secure the two sleeves for receiving the spring therein while maintaining the convenience in use, and the two sleeves being liable to rub against each other and wear away accordingly.

BRIEF SUMMARY OF THE INVENTION

In the central rotating shaft of a rack for tissue scroll in accordance with the present invention, a inner sleeve passes through a cover ring, and a spring is placed against an opening end of the inner sleeve; then the opening end of the inner sleeve and the spring are received in an opening end of a outer sleeve, and finally, the cover ring is engaged with the opening end of the outer sleeve such that the inner sleeve can slide between the outer sleeve and the cover ring by means of the force of the spring. Further, the diameter of the inner sleeve is smaller than that of the outer sleeve and the cover ring is positioned against a protrusion rim of the inner sleeve and a flange of the outer sleeve so that the inner and outer sleeve will not rub against each other nor wear away.

The two ends of the central rotating shaft of the rack for tissue scroll according to the present invention are each provided with a vent grid respectively for diffusing the fragrance of the aromatic if received in the central rotating shaft.

OBJECTS OF THE INVENTION

An object of the present invention is to provide a central rotating shaft of a rack for tissue scroll wherein the rotating shaft is retractable so as to be fitted in the racks with different length for different tissue sizes.

Another object of the present invention is to provide a central rotating shaft of a rack for tissue scroll wherein as the retraction motion will cause any rubbing and wearing.

Another object of the present invention is to provide a central rotating shaft of a rack for tissue scroll wherein the structure is simple and easy to be manufactured, and in the present invention, it is especially suitable to use transparent material, such as transparent acrylic material to manufacture the cover ring, upper and outer sleeve in order to produce a special visual effect for users.

Another object of the present invention is to provide a central rotating shaft of a rack for tissue scroll wherein the assembling of the shaft is very simple and can be performed without any aid of hand tools.

A further object of the present invention is to provide a central rotating shaft of a rack for tissue scroll wherein the use manner of the present invention, such as the manner for replacing the old tissue scroll with a new tissue scroll, is the same as that of the conventional product of the same kind and will not cause any inconvenience for users, and can be easily used in replace of the conventional products of the stone kind.

BRIEF DESCRIPTION OF THE DRAWINGS

The features and functions of the present invention can be best understood from the following detailed description of the preferred embodiment and the accompanying drawings, wherein.

DETAILED DESCRIPTION OF THE INVENTION

Figure 1:
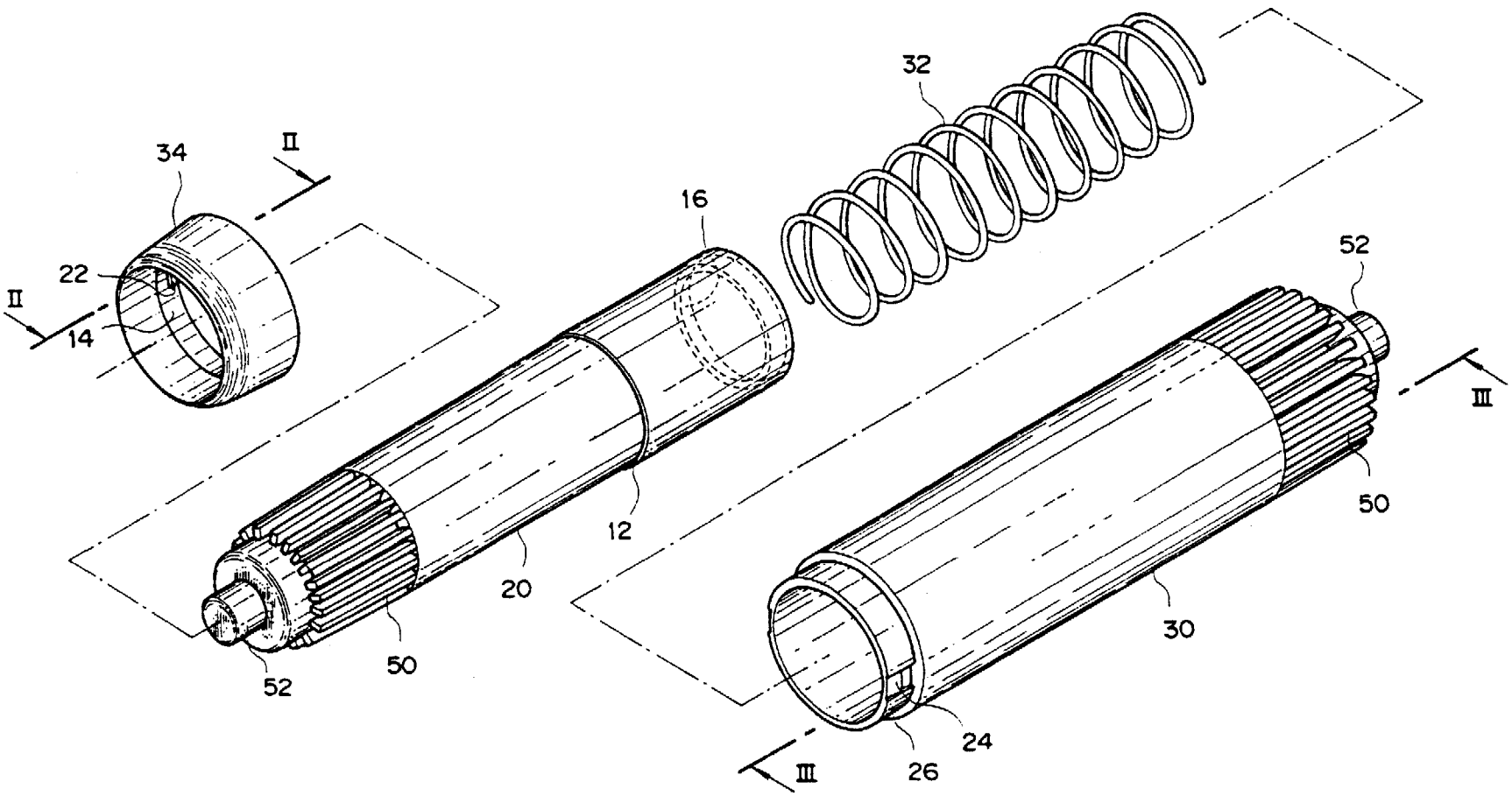
FIG. 1 is an exploded perspective view showing a central rotating shaft of a rack for tissue scroll in accordance with the present invention.
Figure 3:
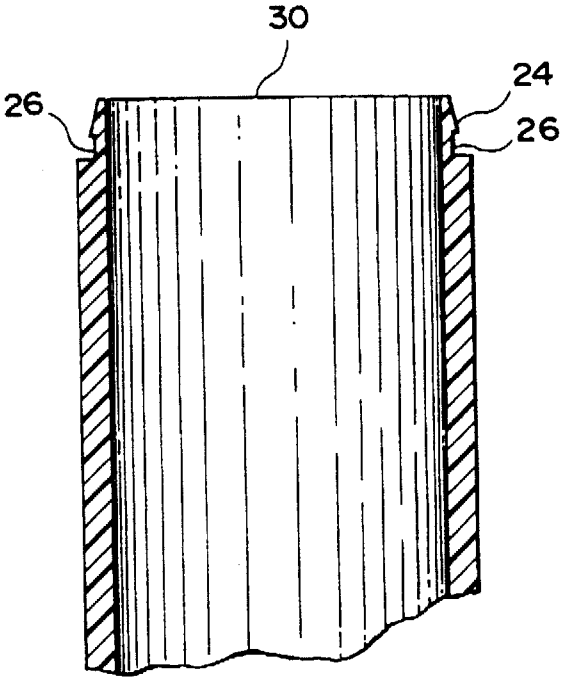
FIG. 3 is a sectional view taken along line III—III of FIG. 1.
Figure 2:
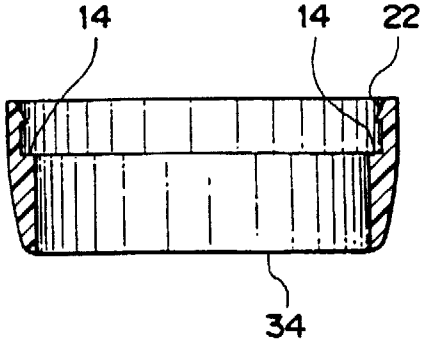
FIG. 2 is a sectional view taken along line II—II of FIG. 1.
Figure 4:
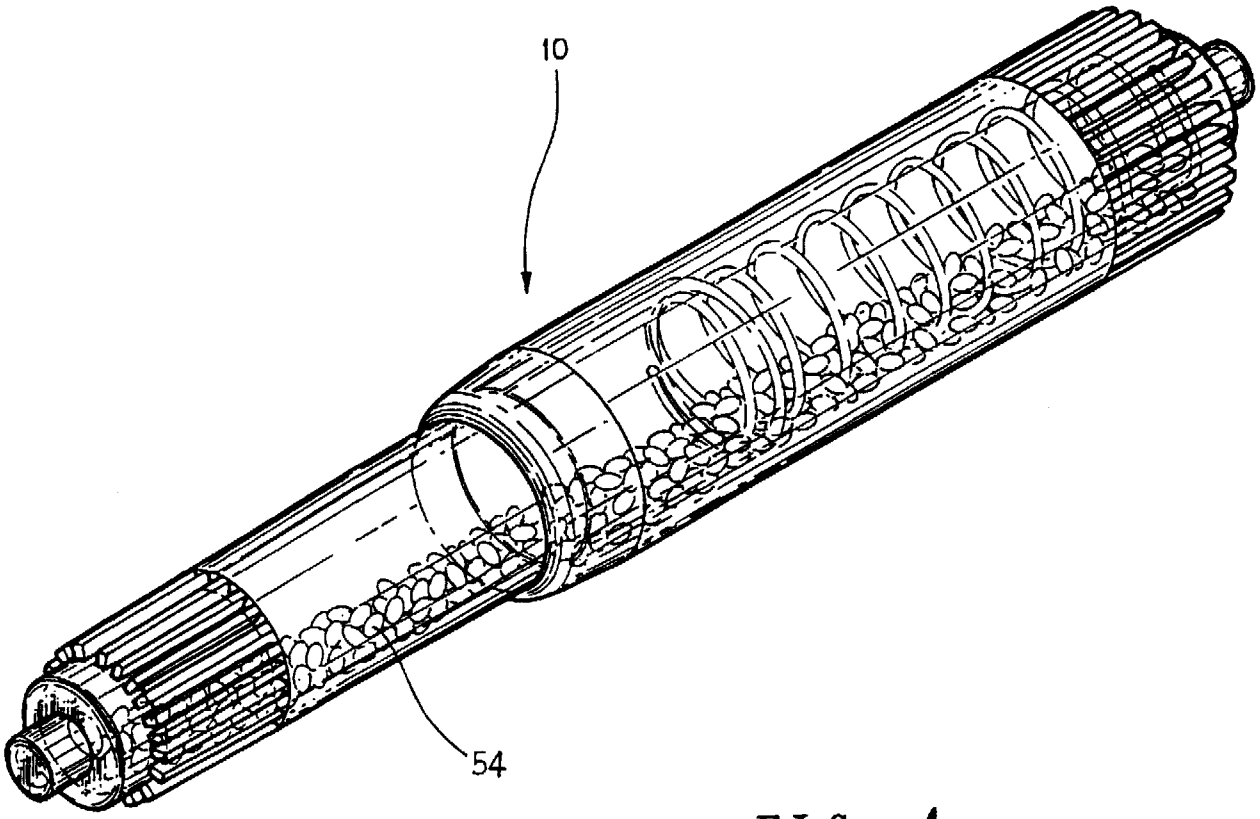
FIG. 4 is a view showing the assembled central rotating shaft of a rack for tissue scroll in accordance with the present invention.
Figure 5:
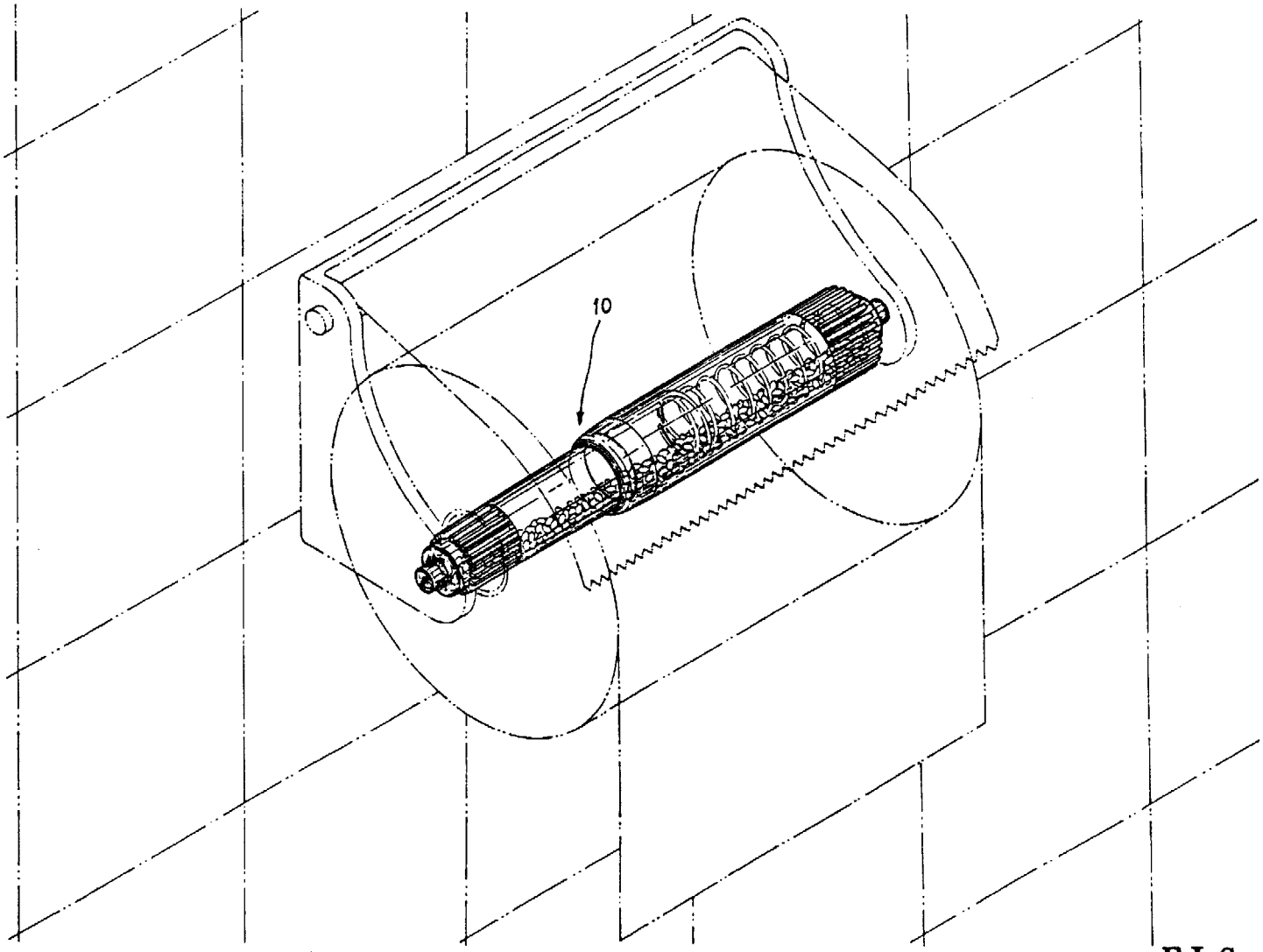
FIG. 5 is a schematic view showing the use condition of the central rotating shaft of a rack for tissue scroll in accordance with the present invention.

Please refer to FIGS. 1–5. A central rotating shaft 10 of a rack for tissue scroll in accordance with the present invention comprises:

a cover ring 34 having a first annular groove 14 provided on its inside periphery at one end thereof, said first annular groove 14 having at least one projection 22 (see FIGS. 1 and 2);

a inner sleeve 20 of which one end is provided with a projecting end 52 and another end is an opening end having a second annular groove 16 on the inside periphery thereof, a protrusion rim 12 being provided near the opening end whereby when the inner sleeve 20 passes through the cover ring 34, the first annular groove 14 is blocked by the protrusion rim 12 and thus the cover ring 34 can be positioned in place against the protrusion rim (see FIGS. 1,4 and 5);

a spring 32 being placed at the opening end of the inner sleeve 20 and against the second annular groove 16 in order to be positioned in place (see FIGS. 1, 4 and 5);

a outer sleeve 30 of which one end is provided with a projecting end 52, and another end is an opening end for receiving the whole spring 32 and the partial inner sleeve 20 and has a flange 26 which is provided with at least one corresponding recess 24 (see FIGS. 1 and 3) for being engaged with the projection 22 of the cover ring 34 such that the inner sleeve 20 can be retractable between the outer sleeve 30 and the cover ring 34 by means of the force of the spring 32 (see FIG. 4).

Further, a vent grid 50 can be provided near the projecting ends 52 of the upper and outer sleeves 20, 30, which can make the central rotating shaft have a more pleasant appearance and can diffuse the fragrance of aromatic 54 if being placed in the upper and outer sleeves 20, 30 depending on the demand (see FIGS. 1, 4 and 5).

As the diameter of the inner sleeve is smaller than that of the outer sleeve and the cover ring is positioned against the protrusion rim of the inner sleeve and the flange of the outer sleeve, the inner and outer sleeve may not contact with each other so that the inner and outer sleeve will not rub against each other nor wear away.

As the problem of rubbing and wearing is solved by providing the cover ring 34 according to the present invention, the upper and outer sleeves 20, 30 can also be made of transparent material, such as transparent acrylic material such that the whole central rotating shaft 10 for tissue scroll can produce special visual effect for users. Especially, when adopting aromatics 54 having different colors, it can produce different visual effect other than the expected fragrant effect.

DESCRIPTION OF THE REFERENCE NUMERALS

10 central rotating shaft of a rack for tissue scroll
12 protrusion rim
14 first annular groove
16 second annular groove
20 inner sleeve
22 projection
24 recess
26 flange
30 outer sleeve
32 spring
34 cover ring
50 vent grid
52 projecting end
54 aromatic

I claim:

1. A central rotating shaft of a rack for tissue scroll, comprising:

a cover ring having a first annular groove provided on the inside periphery at one end thereof, said first annular groove having a plurality of projections;

a inner sleeve of which one end is provided with a projecting end and another end is an opening end having a second annular groove on its inside periphery, a protrusion rim being provided near said opening end whereby when said inner sleeve passes through said cover ring, said first annular groove is blocked by said protrusion rim such that said cover ring can be positioned in place against said protrusion rim;

a spring being placed at said opening end of said inner sleeve and against said second annular groove in order to be positioned in place; and a outer sleeve of which one end is provided with a projecting end, and another end is an opening end for receiving said spring and said inner sleeve and has a flange which is provided with a plurality of corresponding recesses for being engaged with said projections of said cover ring such that said inner sleeve can be retractable between said outer sleeve and said cover ring by means of the force of said spring.

2. A central rotating shaft of a rack for tissue scroll as claimed in claim 1, wherein vent grids are respectively provided near said projecting ends of said inner and outer sleeves.

3. A central rotating shaft of a rack for tissue scroll as claimed in claim 2, wherein aromatic can be placed in said inner and outer sleeves.

4. A central rotating shaft of a rack for tissue scroll as claimed in claim 1, wherein said inner and outer sleeves can be made of transparent material.

5. A central rotating shaft of a rack for tissue scroll as claimed in claim 4, wherein said transparent material is acrylic material.

* * * * *

UNITED STATES PATENT AND TRADEMARK OFFICE

CERTIFICATE OF CORRECTION

PATENT NO. : 5,727,751

DATED : March 17, 1998

INVENTOR(S) : Jackie Liu

It is certified that error appears in the above-indentified patent and that said Letters Patent is hereby corrected as shown below:

In col. 2, line 25, please delete "stone" and insert in lieu thereof --same--.

Signed and Sealed this

Ninth Day of June, 1998

*Attest:*

Bruce Lehman

BRUCE LEHMAN

*Attesting Officer*

*Commissioner of Patents and Trademarks*